US009145737B2

(12) United States Patent
Kang et al.

(10) Patent No.: US 9,145,737 B2
(45) Date of Patent: Sep. 29, 2015

(54) CORING SYSTEM CONSIDERING TILTING OF CORING PART AND METHOD OF COMPENSATING DEPTH OF CORING PART USING THE SAME

(71) Applicant: KOREA INSTITUTE OF GEOSCIENCE AND MINERAL RESOURCES, Daejeon (KR)

(72) Inventors: Moo Hee Kang, Daejeon (KR); Gee Soo Kong, Daejeon (KR); Kyong O Kim, Daejeon (KR); Jin Ho Kim, Daejeon (KR); Young Ho Yoon, Daejeon (KR); Chang Sik Lee, Gyeonggi-do (KR); Kyu Jung Kim, Gyeonggi-do (KR)

(73) Assignee: Korea Institute of Geoscience and Mineral Resources, Daejeon (KR)

( * ) Notice: Subject to any disclaimer, the term of this patent is extended or adjusted under 35 U.S.C. 154(b) by 0 days.

(21) Appl. No.: 14/222,290

(22) Filed: Mar. 21, 2014

(65) Prior Publication Data

US 2015/0136486 A1 May 21, 2015

(30) Foreign Application Priority Data

Nov. 15, 2013 (KR) ..... 10-2013-0138969

(51) Int. Cl.

| | |
|---|---|
| ***E21B 7/12*** | (2006.01) |
| ***E21B 25/00*** | (2006.01) |
| ***E21B 25/18*** | (2006.01) |
| ***E21B 49/02*** | (2006.01) |
| ***E21B 49/00*** | (2006.01) |
| ***E21B 47/024*** | (2006.01) |

(52) U.S. Cl.

CPC . *E21B 7/12* (2013.01); *E21B 25/00* (2013.01); *E21B 47/024* (2013.01); *E21B 49/003* (2013.01)

(58) Field of Classification Search

CPC ..... E21B 7/12; E21B 25/00; E21B 25/16; E21B 25/18; E21B 47/02; E21B 47/026; E21B 49/001; E21B 49/02; E21B 49/025

USPC ..... 175/5, 40, 44, 45, 58

See application file for complete search history.

(56) References Cited

U.S. PATENT DOCUMENTS

| | | | | |
|---|---|---|---|---|
| 2,011,979 | A * | 8/1935 | Martienssen | 175/44 |
| 3,299,969 | A * | 1/1967 | Inderbitzen | 175/5 |
| 3,353,612 | A * | 11/1967 | Bannister | 175/6 |
| 3,373,827 | A * | 3/1968 | Biron et al. | 175/6 |
| 3,434,551 | A * | 3/1969 | Rosfelder | 175/6 |
| 3,875,796 | A * | 4/1975 | Gilliard | 73/170.32 |
| 4,217,709 | A * | 8/1980 | Casciano | 37/308 |
| 7,584,055 | B2 * | 9/2009 | Parfitt | 702/9 |

(Continued)

FOREIGN PATENT DOCUMENTS

| | | |
|---|---|---|
| JP | 06042969 | 2/1994 |
| JP | 2002104280 | 4/2002 |

(Continued)

*Primary Examiner* — Matthew Buck

(74) *Attorney, Agent, or Firm* — Cesari and McKenna, LLP

(57) ABSTRACT

The present invention relates to a coring system considering a tilt of a coring part and a method of compensating for a depth of a coring part using the same. A coring system according to the present invention includes: a coring part with a core to be filled with an object to be cored; a driving unit controlling upward/downward movement of the coring part; a rope connecting the coring part with the driving unit; and a tilt meter measuring a tilt of the coring part.

10 Claims, 9 Drawing Sheets

(56) References Cited

U.S. PATENT DOCUMENTS

| | | | | |
|---|---|---|---|---|
| 2007/0239360 | A1 | 10/2007 | Rabinovich | |
| 2011/0247881 | A1 * | 10/2011 | Orban et al. | 175/244 |

FOREIGN PATENT DOCUMENTS

| | | | |
|---|---|---|---|
| JP | 2010285133 | A | 12/2010 |
| KR | 1020100111275 | | 5/2012 |

* cited by examiner

CORING SYSTEM CONSIDERING TILTING OF CORING PART AND METHOD OF COMPENSATING DEPTH OF CORING PART USING THE SAME

CROSS-REFERENCE TO RELATED APPLICATION

The application claims the benefit of Korean Patent Application No. 10-2013-0138969 filed on Nov. 15, 2013 and the entire contents of which are incorporated herein by reference.

BACKGROUND

1. Field of the Disclosure

The present invention relates to a coring system considering a tilt of a coring part and a method of compensating for depth of a coring part using the same.

2. Description of the Related Art

There have been developed many coring rigs for studying underground resources or observing the history and the environmental change of the earth.

Most coring rigs place a coring part with a core for carrying an object to be cored, on the bottom of the sea or the bottom of a river and then insert it into a sediment, using the gravity etc. When the coring part is inserted in the sediment, some of the sediment comes into the core, and a sample of the sediment is obtained by returning the coring part.

However, because the coring part is inserted deep in the bottom of the sea or the bottom of a river in most cases of coring, there is a problem in that it is difficult to know whether the coring part is inserted in a sediment while keeping vertical.

When a coring part is not vertically inserted in a sediment, there is a problem in that the position (depth) of the expected sample in the sediment and the position (depth) of the actually obtained sample in the sediment become different.

FIG. 1 shows a case when a coring part is accurately inserted in a sediment while keeping vertical and FIG. 2 shows a case when a coring part is inaccurately inserted at a angle in the bottom of the sea.

When samples with the same length of the sediment are picked in the core of the coring part, the coring of FIG. 1 and the coring of FIG. 2 are made at different depths.

When coring is performed at an angle, as in FIG. 2, however, the existing coring systems cannot compensate for the error to the actual depth.

PRIOR ART DOCUMENT

Patent Document

Korean Patent Publication No. 2012-0049995 (published on May 18, 2012)

U.S. Pat. No. 7,333,891 (published on 19 Feb. 2008)

SUMMARY

The present invention has been made in an effort to provide a coring system considering a tilt of a coring part and a method compensating for depth of a coring part using the same.

An aspect of the present invention provides a coring system including: a coring part with a core to be filled with an object to be cored; a driving unit controlling upward/downward movement of the coring part; a rope connecting the coring part with the driving unit; and a tilt meter measuring a tilt of the coring part.

The coring system may further include a depth meter measuring a depth of the coring part.

The coring part may include a weight having an internal space, and the tilt meter and the depth meter are disposed in the internal space.

The weight may include a plurality of C-shaped sub-weights, and at least any one of the tilt meter and the depth meter may be disposed through the sub-weights.

The weight may be a single part.

The coring system may further include a depth compensating unit that compensates for the actual depth of the coring part, using data of the tilt meter and the depth meter.

Another aspect of the present invention provides a method that compensates for a tilt of a coring part in a coring system including a coring part with a core to be filled with an object to be cored, a driving unit controlling up-down movement of the coring part, and a rope connecting the coring part with the driving unit. The method of compensating a depth may include: measuring a tilt and a depth of the coring part; and compensating for the actual coring depth of the coring part on the basis of the measured tilt and depth.

The actual coring depth may be calculated by calculating a change in the tilt to the depth in the compensating.

A tilt meter measuring a tilt and a depth meter measuring a depth may be disposed in the coring part.

The coring part may include a weight with an internal space, and a tilt meter measuring a tilt and a depth meter measuring a depth may be disposed in the internal space.

The weight may include a plurality of C-shaped sub-weights, and at least any one of the tilt meter and the depth meter may be disposed through the sub-weights.

The weight may be a single part.

According to the present invention, a coring system considering a tilt of a coring part and a method of compensating for a depth of a coring part using the same are provided.

DETAILED DESCRIPTION OF THE EMBODIMENT

Hereinafter, the present invention will be described in detail with reference to the accompanying drawings.

The accompanying drawings are only examples for illustrating the spirit of the present invention in detail and the scope of the present invention is not limited thereto.

Although a type of coring part using a weight is exemplified in the following description, the coring part of the present invention may be used for a type using a piston or a box type of coring.

Further, although it is exemplified in the following description to core a sediment on the bottom of the sea, the present invention may be used for coring a sediment or other objects on the bottom of a river.

Figure 1:
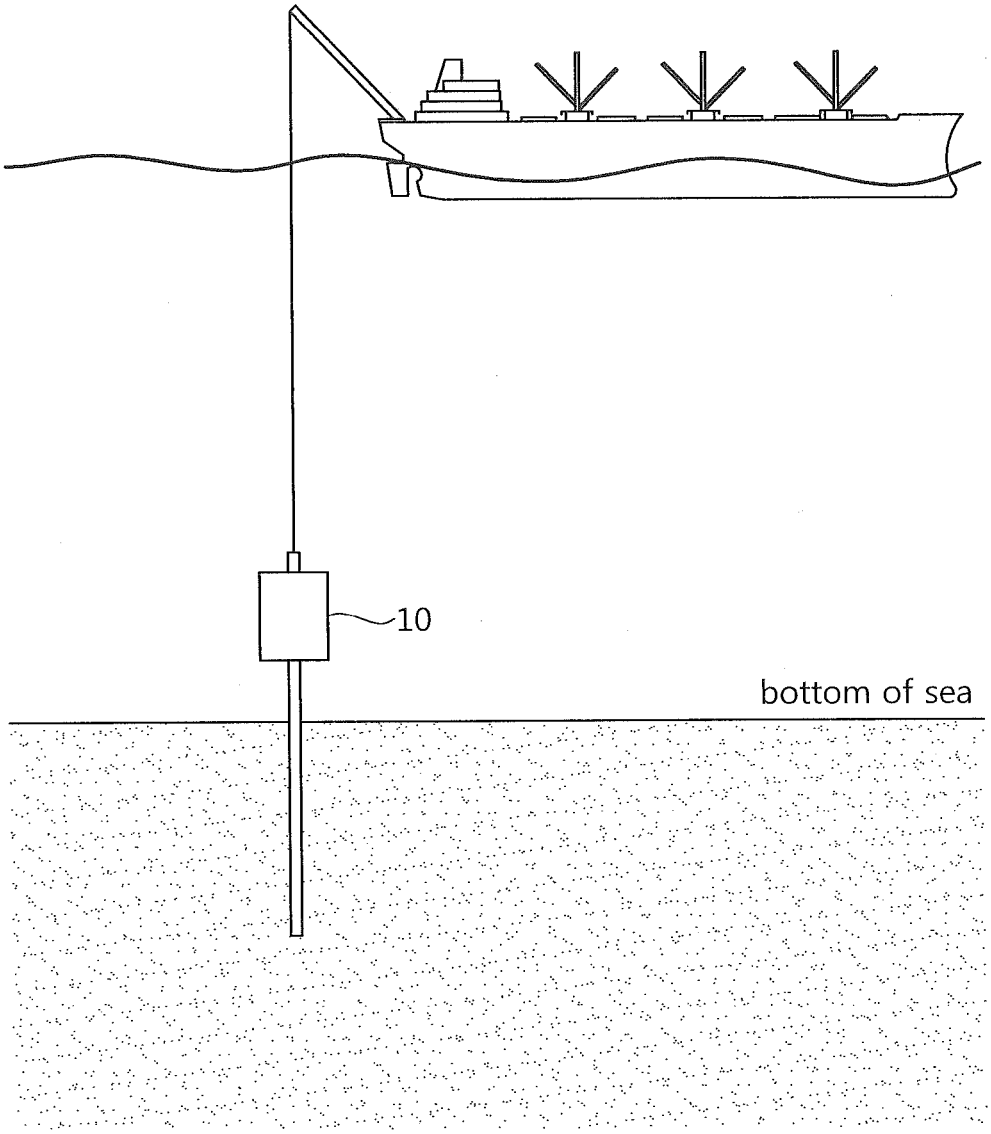
FIG. 1 is a view showing a case when coring is vertically performed.
Figure 2:
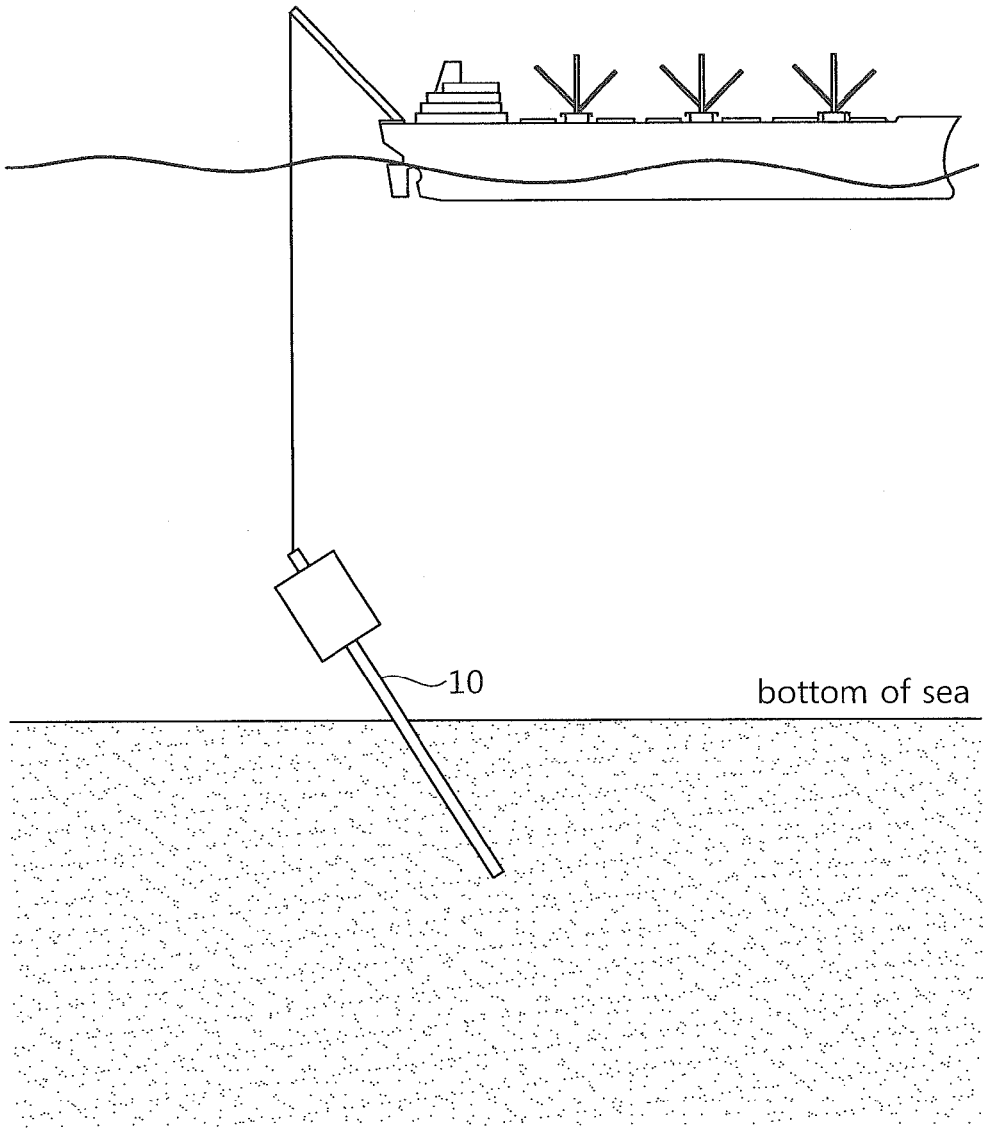
FIG. 2 is a view showing a case when coring is performed at an angle.
Figure 3:
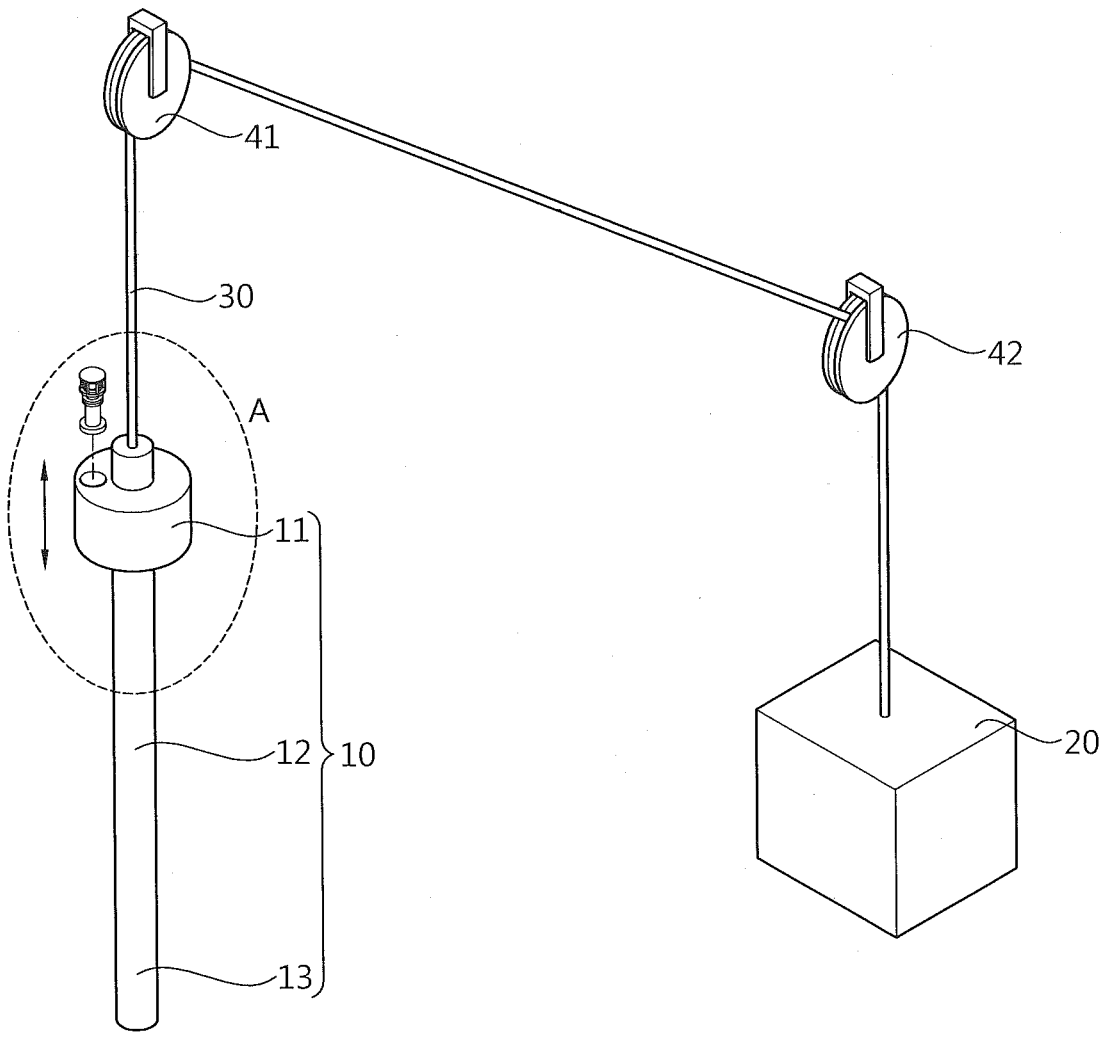
FIGS. 3 to 5 are views showing a coring system according to an embodiment of the present invention.
Figure 4:
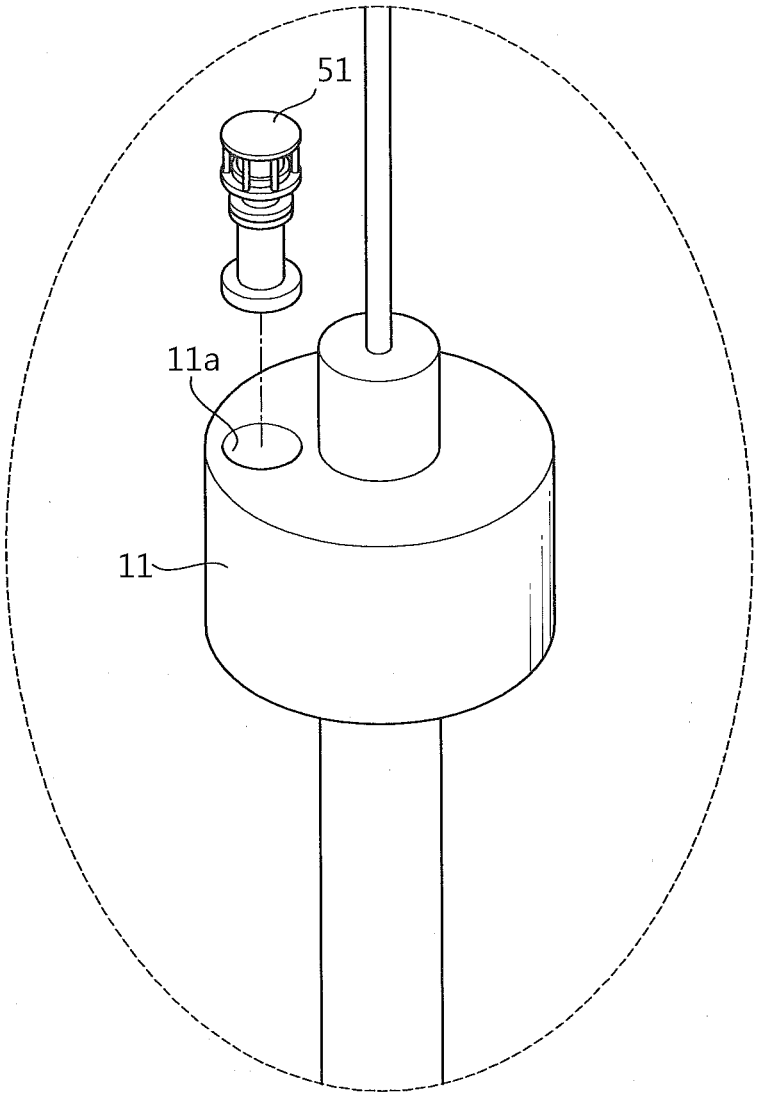
Figure 5:
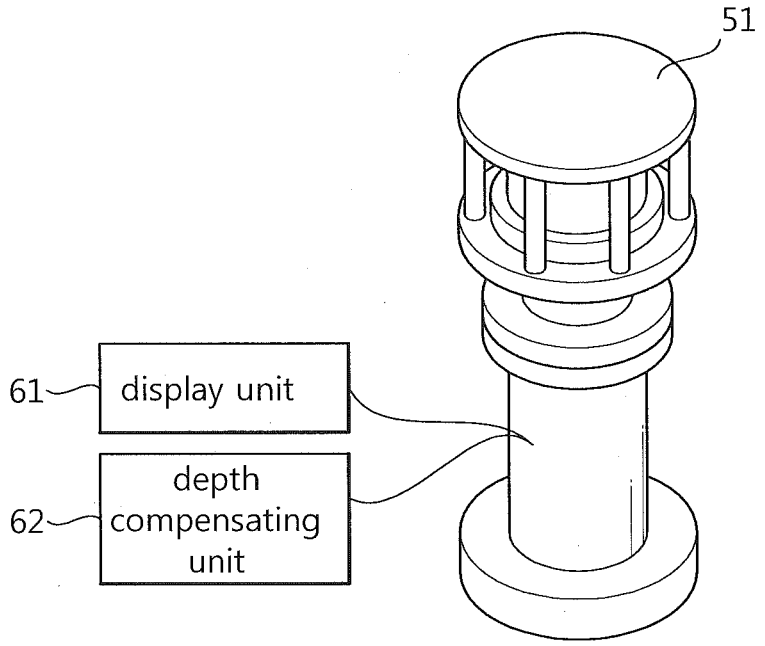

A coring system according to an embodiment of the present invention is described with reference to FIGS. 3 to 5.

A coring system 1 includes a coring part 10, a driving unit 20, a rope 30, and a tilt/depth meter 51.

The coring part 10 and the driving unit 20 are connected through a rope 30 and the coring part 10 is moved up/down by operation of the driving unit 20. The tilt/depth meter 51 measures a tilt and a depth of the coring part 10.

The coring part 10 is composed of a weight and a coring rod 12 and a coring core 13 that is an empty space in which a sediment can be picked is formed in the coring rod 12. The top of the weight 11 is connected to the rope 30 and the coring part 10 is moved up/down by operation of the driving unit 20.

As the rope 30 is loosened after the coring part 10 is placed on the bottom of the sea, the coring rod 12 is inserted into a sediment by the weight of the weight 11. A sample of the sediment is picked into the coring core 13 in the insertion.

The driving unit 20 may be implemented by an electric motor etc. and moves up/down the coring part 10. When coring is controlled on a ship, the driving unit 20 is disposed on the ship. In detail, the driving unit 20 may be an electric winch.

The rope 30 connects the driving unit 20 with the coring part 10 and transmits the power from the driving unit 20 to the coring part 10. The rope 30 may be any one as long as it is made of a material suitable for power transmission. For example, a natural substance rope, a synthetic resin rope, a metal wire, or a chain may be used.

The extension direction of the rope 30 is changed by two pulleys 41 and 42. The extension direction of the rope 30 is changed vertically in the direction of gravity on the coring part 10 by the first pulley 41 and is changed too between the driving unit 20 and the first pulley 41 by the second pulley 42. The first pulley 41 may be disposed at the end of a crane on a ship.

The second pulley 42 may not be provided in another embodiment and pulleys may be additionally used in another embodiment.

The tilt/depth meter 51 is disposed in the weight 11. The weight 11 has an internal space 11*a* and the tilt/depth meter 51 is positioned in the internal space 11*a*.

The tilt and depth measured by the tilt/depth meter 51 is transmitted to a display unit 61 and a depth compensating unit 62 by wire or wireless communication. The display unit 61 displays changes in depth and tilt, as coring proceeds (time passes), for the convenience of a user. Though not shown, a storing unit for storing the depth and tilt data may be provided. The depth compensating unit 62 calculates the actual coring depth on the basis of the measured tilt and depth.

The embodiment may be modified in various ways. A depth meter and a tilt meter may be separately disposed in the coring part 10. Further, only a tilt meter may be provided without a depth meter. When there is only a tilt meter, it is possible to calculate the actual depth from the length of the sample of the sediment. Further, it is possible to determine whether coring was vertically performed well, even though there is only a tilt meter.

Although the depth/tilt meter 51 is in the weight 11 in the embodiment described above, the depth/tilt meter 51 may be disposed outside the weight 11 or attached to the coring rod 12.

Common depth/tilt meters, depth meters, and tilt meters which have appropriate performance can be used and they may be modified to be waterproof or accommodated in the weight 11.

Figure 6:
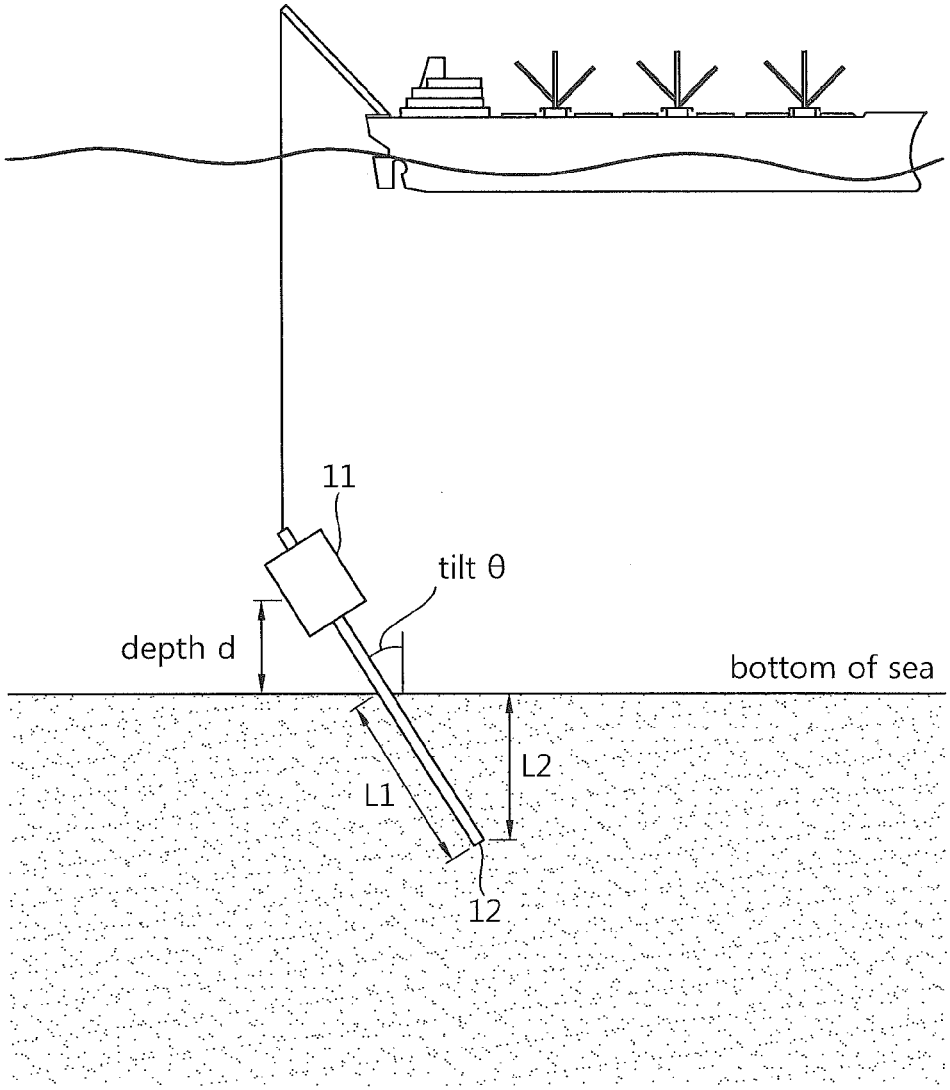
FIG. 6 is a view showing a method of compensating for a depth according to an embodiment of the present invention.

A method of calculating the actual coring depth by the depth compensating unit is described hereafter with reference to FIG. 6.

As coring is performed, the depth/tilt meter 51 measures an angle θ and a depth d. The measured result is transmitted to the depth compensating unit 62.

When coring is performed at an angle, a difference is generated between the length L1 of the coring rod inserted in the bottom of the sea and the actual coring depth L2 of the bottom of the sea. The depth compensating unit E2 estimates the actual coring depth L2 of the bottom of the sea from the measured tilt θ and depth d.

On the other hand, the insertion angle may change in coring, in which the depth compensating unit 52 can calculate the actual coring depth for the lengths of the samples of the sediment, using the data of the tilt θ changing with the depth d.

Figure 7:
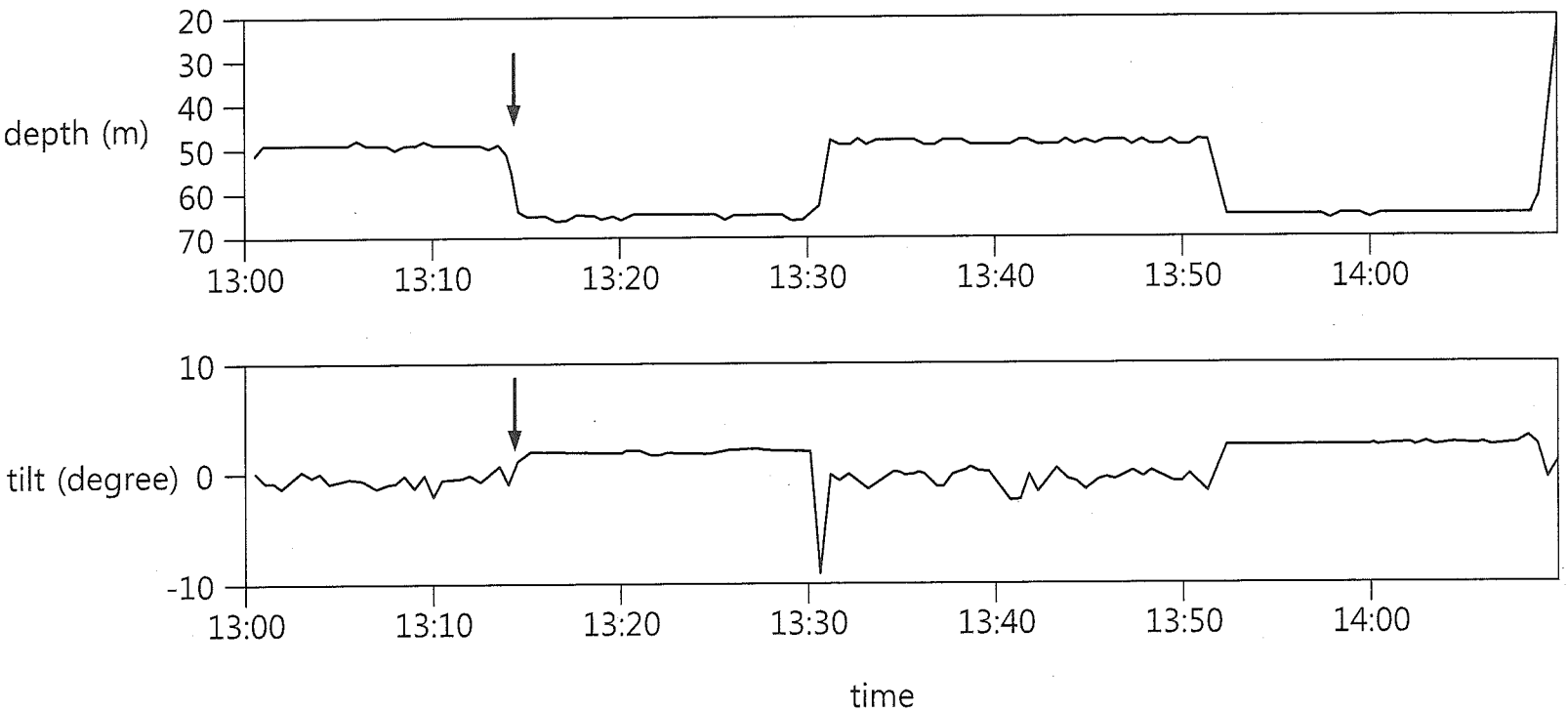
FIG. 7 is a view showing an example of measuring a depth and a tilt according to an embodiment of the present invention.
Figure 8:
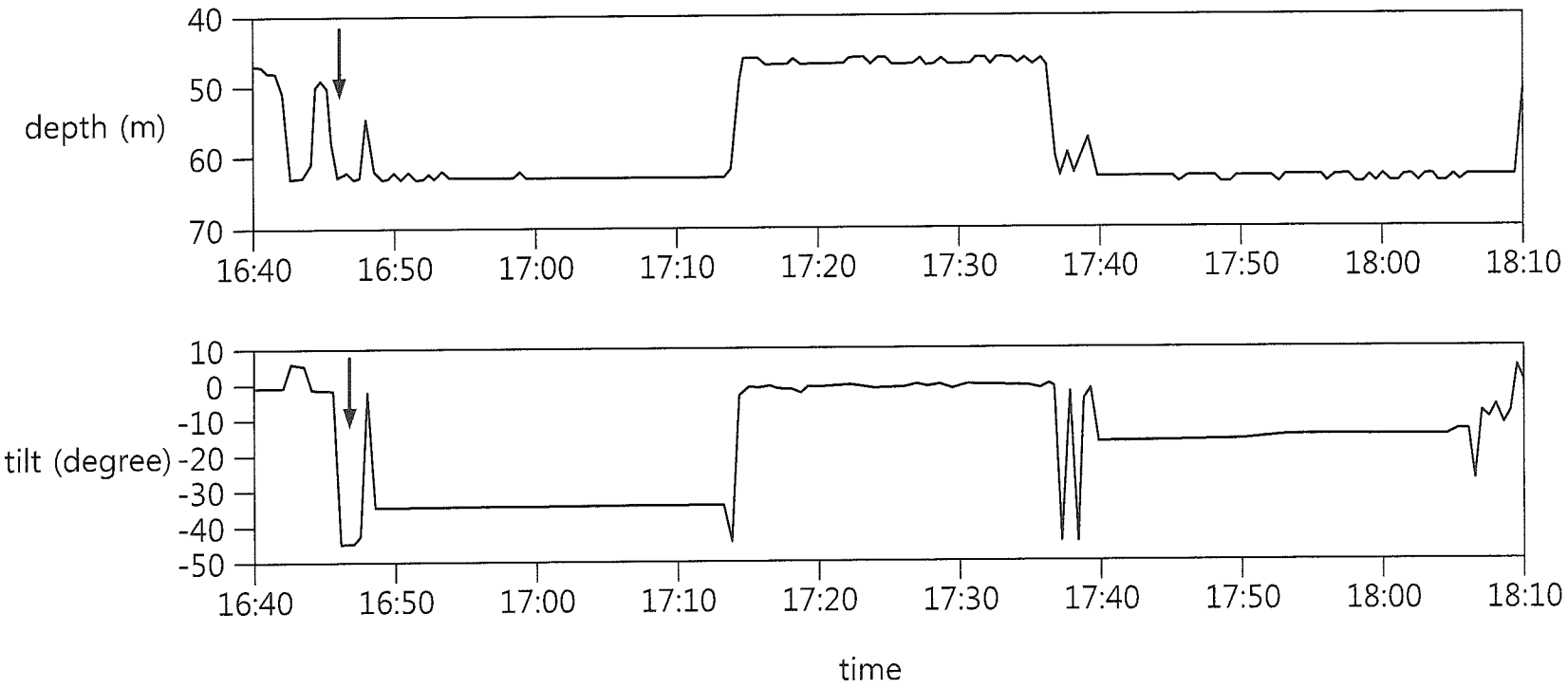
FIG. 8 is a view showing another example of measuring a depth and a tilt according to an embodiment of the present invention.

Examples of measuring a depth and a tilt are described hereafter with reference to FIGS. 7 and 8. FIG. 7 shows a case when the tilt of the coring part 10 is small, 2~3 degrees, and FIG. 8 shows a case when the tilt of the coring part 10 is large, over 30 degrees. The arrows in FIGS. 7 and 8 indicate the start points where the coring part 10 is inserted into the bottom of the sea.

Referring to FIG. 7, the depth reduces by over 10 m by insertion of the coring part 10. The tilt of the coring part 10 changes little in this case. On the other hand, referring to FIG. 8, the coring part 10 is inclined at over 30 degrees when the coring part 10 is inserted.

The depth compensating unit 52 compensates for the depths to the actual depth in both of FIGS. 7 and 8 and the effect of depth compensation is great when the coring tilt is large, particularly as in FIG. 8.

Figure 9:
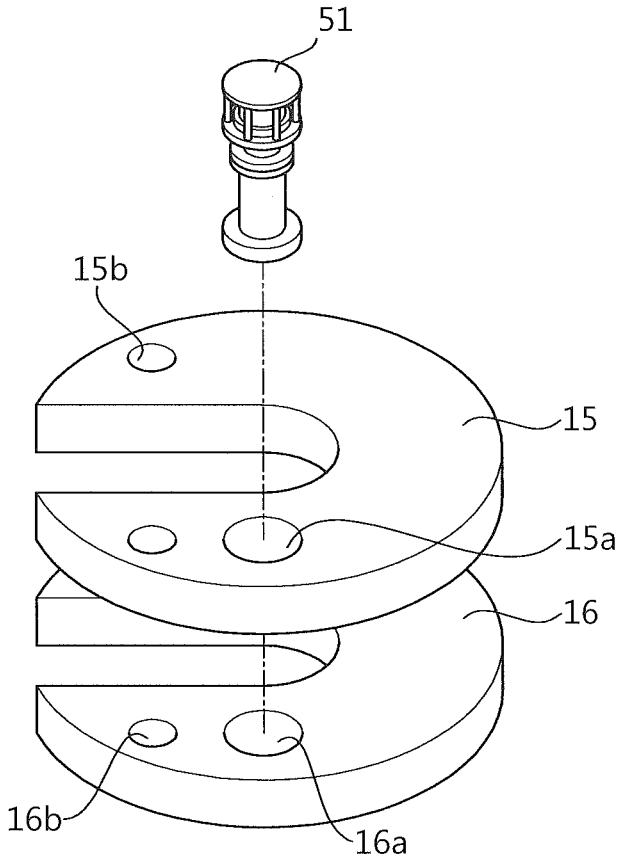
FIG. 9 is a view showing a coring system according to another embodiment of the present invention.

A coring system according to another embodiment of the present invention is described hereafter with reference to FIG. 9.

The weight 11 is composed of a plurality of sub-weights 15 and 16. The sub-weights 15 and 16 are formed in a C-shape and the number of the sub-weight can be adjusted. The sub-weights 15 and 16 have internal spaces 15*a* and 16*a*, respectively, and the tilt/depth meter 51 is inserted in the internal spaces 15 and 16.

Further, the sub-weights 15 and 16 have coupling holes 15*b* and 16*b*, respectively, and are fixed in close contact by separate fastening members through the coupling holes 15*b* and 16*b*.

In another embodiment, a tilt/depth meter may be disposed through three or more sub-weights and a tilt meter and a depth meter may be separately disposed.

According to the present invention described above, it is possible to know the actual coring depth by measuring the tilt and the depth.

The embodiments described above are examples for describing the present invention and the present invention is not limited thereto. The present invention may be achieved in various ways by those skilled in the art and the scope of the present invention should be determined by claims.

What is claimed is:

1. A coring system comprising:

a coring part with a core to be filled with an object to be cored;

a driving unit controlling upward/downward movement of the coring part;

a rope connecting the coring part with the driving unit;

a tilt meter measuring a tilt of the coring part;

a depth meter measuring a depth of the coring part; and a depth compensating unit that compensates for the actual depth of the coring part using data of the tilt meter and the depth meter.

2. The coring system of claim 1, wherein the coring part includes a weight having an internal space, and the tilt meter and the depth meter are disposed in the internal space.

3. The coring system of claim 2, wherein the weight includes a plurality of C-shaped sub-weights, and at least any one of the tilt meter and the depth meter is disposed through the sub-weights.

4. The coring system of claim 2, wherein the weight is a single part.

5. A method that compensates for a tilt of a coring part in a coring system including a coring part with a core to be filled with an object to be cored, a driving unit controlling up-down movement of the coring part, and a rope connecting the coring part with the driving unit, the method of compensating a depth comprising:

measuring a tilt and a depth of the coring part; and compensating for the actual coring depth of the coring part on the basis of the measured tilt and depth.

6. The method of claim 5, wherein the actual coring depth is calculated by calculating a change in the tilt to the depth in the compensating.

7. The method of claim 5, wherein a tilt meter measuring a tilt and a depth meter measuring a depth are disposed in the coring part.

8. The method of claim 6, wherein the coring part includes a weight with an internal space, and a tilt meter measuring a tilt and a depth meter measuring a depth are disposed in the internal space.

9. The method of claim 8, wherein the weight includes a plurality of C-shaped sub-weights, and at least any one of the tilt meter and the depth meter is disposed through the sub-weight.

10. The method of claim 8, wherein the weight is a single part.

* * * * *